US006953164B2

(12) United States Patent
Duncan et al.

(10) Patent No.: US 6,953,164 B2
(45) Date of Patent: Oct. 11, 2005

(54) LAWN IRRIGATION SYSTEM

(75) Inventors: Scott W. Duncan, Bloomington, MN (US); Scott A. Dunlap, Bloomington, MN (US); Stephen Alexander, Vadnais Heights, MN (US)

(73) Assignee: S & S Product Design, Inc., Bloomington, MN (US)

( * ) Notice: Subject to any disclaimer, the term of this patent is extended or adjusted under 35 U.S.C. 154(b) by 0 days.

(21) Appl. No.: 10/695,656

(22) Filed: Oct. 28, 2003

(65) Prior Publication Data

US 2004/0195407 A1 Oct. 7, 2004

Related U.S. Application Data

(62) Division of application No. 10/196,351, filed on Jul. 16, 2002, now Pat. No. 6,637,679.

(60) Provisional application No. 60/305,831, filed on Jul. 16, 2001.

(51) Int. Cl.[7] ..... B05B 17/00

(52) U.S. Cl. ..... 239/722; 239/211; 239/289; 239/748; 239/744; 239/743; 239/747; 239/754

(58) Field of Search ..... 239/211, 289, 239/722, 723, 744, 743, 747, 748, 754

(56) References Cited

U.S. PATENT DOCUMENTS

| | | | | | |
|---|---|---|---|---|---|
| 2,883,116 | A | * | 4/1959 | Muench | 239/748 |
| 2,905,392 | A | * | 9/1959 | Keltner | 239/748 |
| 2,985,380 | A | * | 5/1961 | Jules | 239/748 |
| 3,081,038 | A | * | 3/1963 | Sparks et al. | 239/748 |
| 3,664,367 | A | * | 5/1972 | Schaefer, Jr. | 239/748 |
| 3,972,478 | A | * | 8/1976 | Groelz | 239/748 |
| 6,604,697 | B1 | * | 8/2003 | Heren et al. | 239/723 |
| 6,637,679 | B1 | * | 10/2003 | Duncan et al. | 239/722 |

* cited by examiner

*Primary Examiner*—Dinh Q. Nguyen
(74) *Attorney, Agent, or Firm*—Patterson, Thuente, Skaar & Christensen, P.A.; Michael A. Bondi

(57) ABSTRACT

A lawn irrigation system including a frame, a motor, a sprinkler arm, at least one drive wheel, and a cover. The motor is operably attached to the frame. The at least one drive wheel is operably connected to the motor. The sprinkler arm is operably connected to the motor for dispersing water in a selected pattern. The cover is attached to the frame so that the cover at least partially covers the frame, the motor, and the at least one drive wheel so that the lawn irrigation system resembles an object other than a sprinkler.

5 Claims, 7 Drawing Sheets

LAWN IRRIGATION SYSTEM

REFERENCE TO RELATED APPLICATION

This application is a division of application Ser. No. 10/196,351, filed Jul. 16, 2002, now U.S. Pat. No. 6,637,679 which claims benefit to the filing date of U.S. Provisional Application Ser. No. 60/305,831, filed Jul. 16, 2001. This application is hereby incorporated by reference.

FIELD OF THE INVENTION

The present invention relates generally to a lawn irrigation system. More particularly, the present invention relates to a lawn irrigation system having a decorative outer shell.

BACKGROUND OF THE INVENTION

There are many types of sprinklers for use in irrigating grass. Typically, the sprinkler is placed in a stationary location to irrigate a specified region. Once the lawn in the specified region is sufficiently irrigated, the sprinkler is manually moved to a new location and the process is repeated.

In an attempt to overcome the need to periodically move stationary sprinklers, moving sprinklers have been created. One such moving sprinkler is disclosed in Pescetto, U.S. Pat. No. 4,059,229. In these moving sprinklers, the flow of water through the sprinkler causes the sprinkler to move along the lawn.

SUMMARY OF THE INVENTION

The present invention is directed to a lawn irrigation system that includes a frame, a motor, at least one drive wheel, a sprinkler arm, and a cover. The motor is operably attached to the frame. The at least one drive wheel is operably connected to the motor. The sprinkler arm is operably connected to the motor for dispersing water in a selected pattern. The cover is attached to the frame so that the cover at least partially covers the frame, the motor, and the at least one drive wheel so that the lawn irrigation system resembles an object other than a sprinkler.

DETAILED DESCRIPTION OF THE PREFERRED EMBODIMENTS

Figure 1:
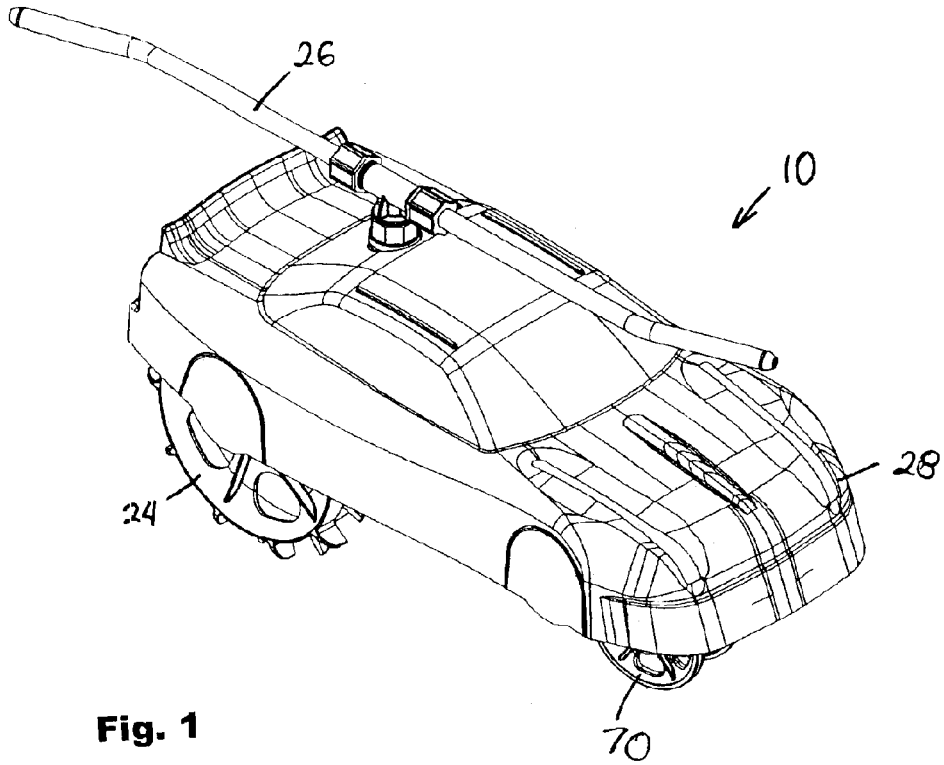
FIG. 1 is a perspective view of a lawn irrigation system according to the present invention.
Figure 2:
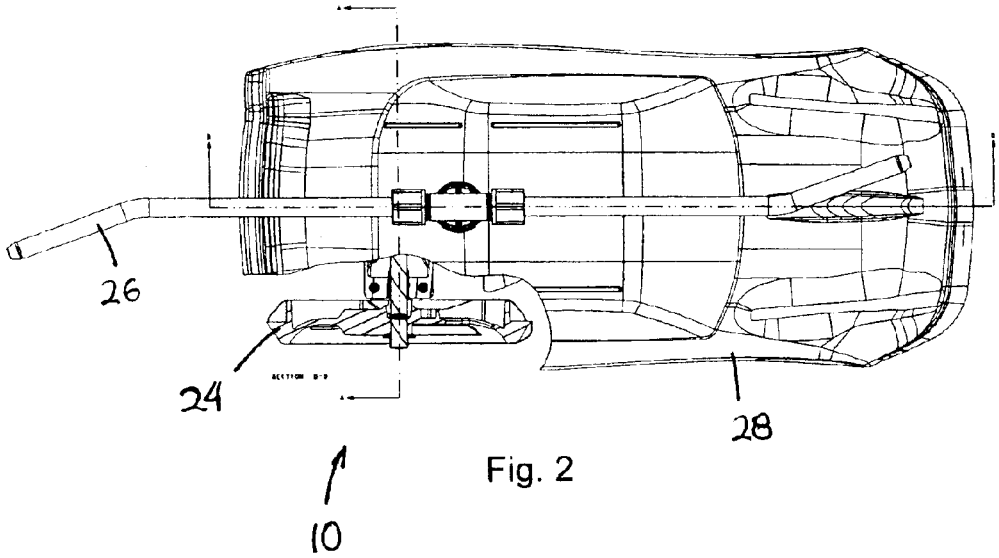
FIG. 2 is a top view of the lawn irrigation system illustrated in FIG. 1.
Figure 3:
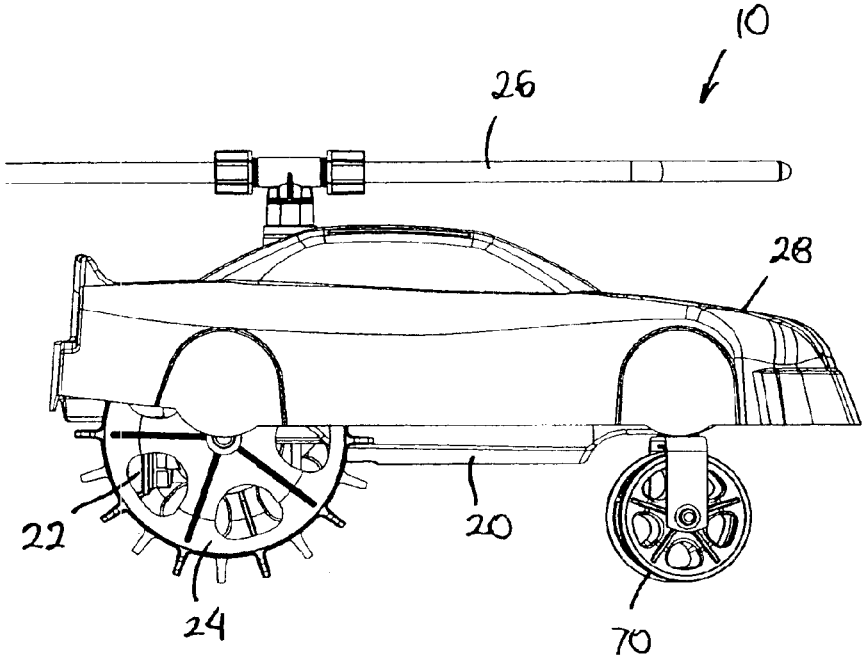
FIG. 3 is a side view of the lawn irrigation system illustrated in FIG. 1.

The present invention is a lawn irrigation system as most clearly illustrated at 10 in FIGS. 1–5. The lawn irrigation system 10 generally includes a frame 20, a motor 22, at least one drive wheel 24, a sprinkler arm 26, and a cover 28.

The lawn irrigation system 10 of the present invention not only moves along a desired path to irrigate a lawn but also prominently displays affiliation with or support of an organization or group.

Figure 5:
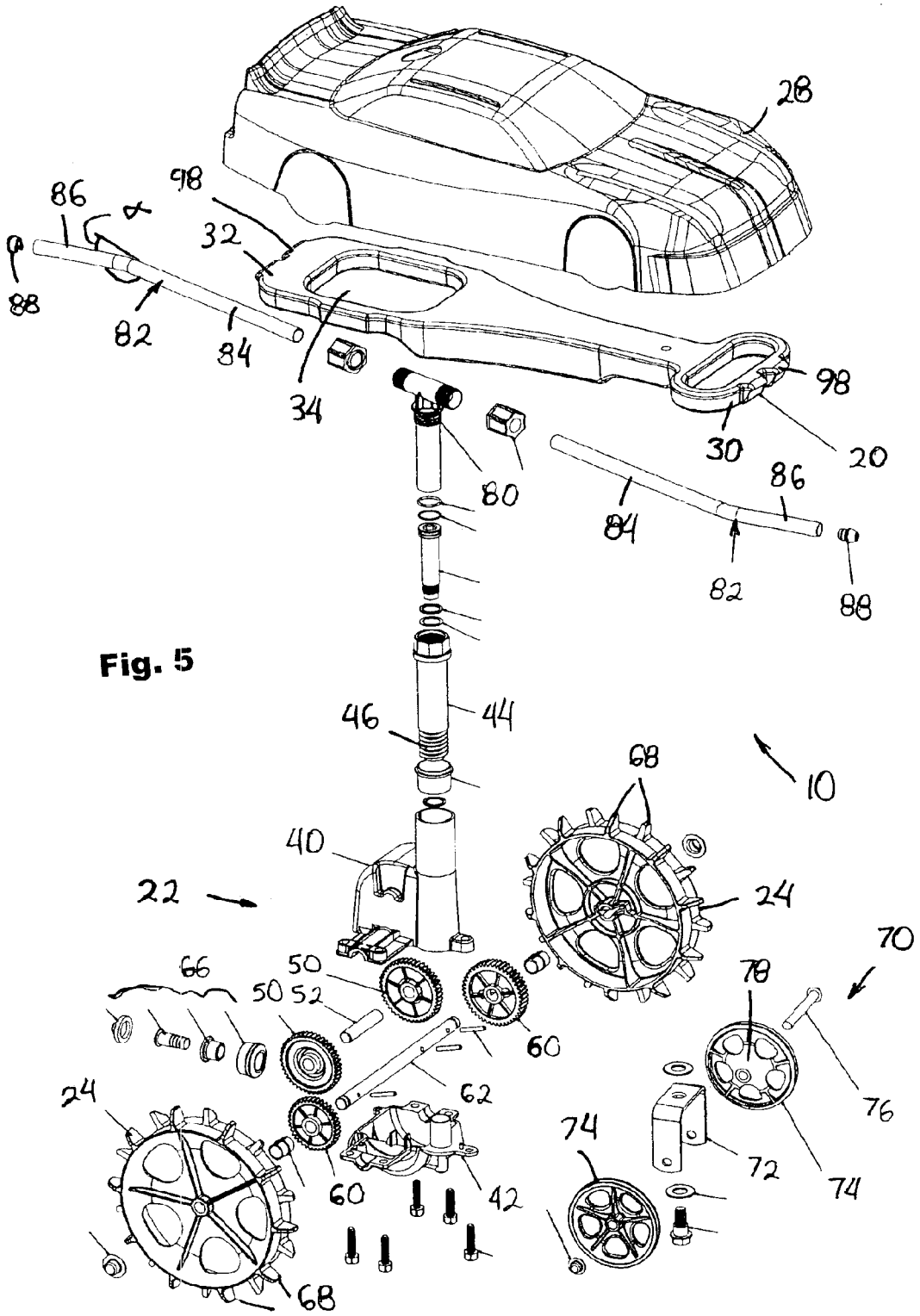
FIG. 5 is an exploded view of the lawn irrigation system illustrated in FIG. 1.

The frame 20 has an elongated configuration with a front end 30 and a back end 32, as most clearly illustrated in FIG. 5. Proximate the back end 32, the frame 20 has a recess 34 formed therein that is adapted to receive the motor 22.

The frame 20 is preferably fabricated from a metallic material to provide the lawn irrigation system 10 with a low center of gravity to enhance the stability of the lawn irrigation system 10 during use.

As the lawn irrigation system 10 will be used with water, the frame 20 is preferably fabricating from a material that does not experience degradation from extended exposure to water. Alternatively, the frame 20 may be covered with a material such as plastic that resists degradation from extended exposure to water.

The motor 22 generally includes an upper case 40 and a lower case 42 that mate together. Extending from the upper case 40 is a worm shaft 44 having a helical groove 46 proximate a lower end thereof.

Rotatably mounted in the upper case 40 is a pair of first gears 50 that are rotatable about a first shaft 52. The first gears 50 operably engage the helical groove 46 on the worm shaft 44. A person of ordinary skill in the art will appreciate that the diameter of the first gears 50 as well as the number of teeth on the first gears 50 is selected based upon a variety of considerations including water flow rate and the rate at which it is desired for the lawn irrigation system 10 to move.

Rotatably mounted in the lower case 42 is a pair of second gears 60 that are rotatable about a second shaft 62. The second gears 60 operably engage the first gears 50. A person of ordinary skill in the art will appreciate that the diameter of the second gears 60 as well as the number of teeth on the second gears 60 is selected based upon a variety of considerations including water flow rate and the rate at which it is desired for the lawn irrigation system 10 to move. The drive wheels 24 are attached to opposite ends of the second shaft 62.

Figure 6:
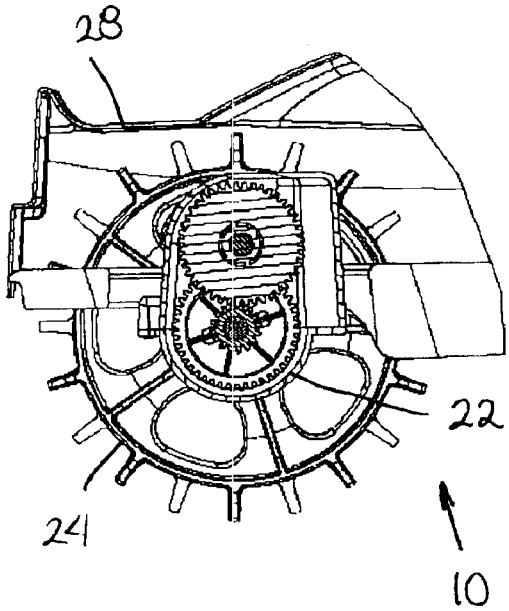
FIG. 6 is a first sectional view of a motor for the lawn irrigation system.
Figure 7:
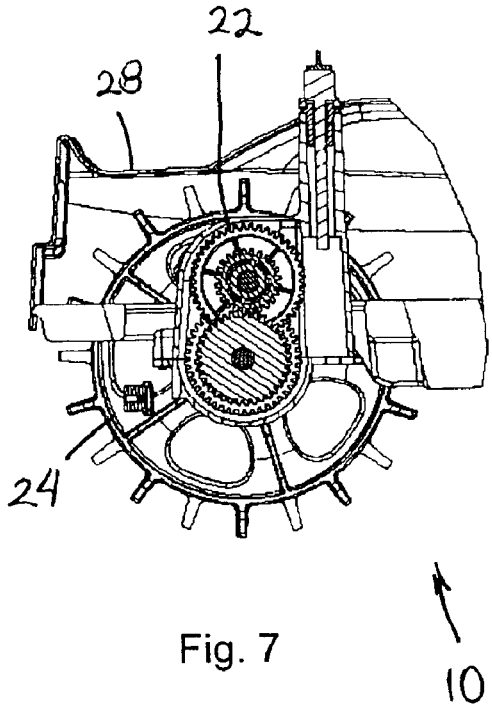
FIG. 7 is a second sectional view of the motor for the lawn irrigation system.
Figure 8:
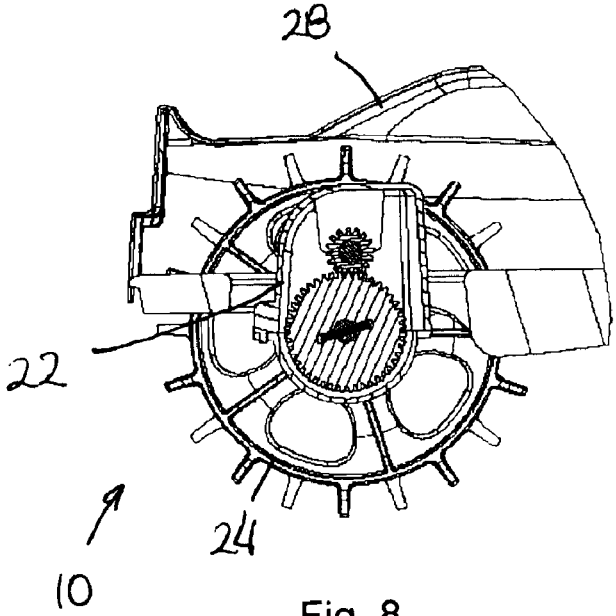
FIG. 8 is a third sectional view of the motor for the lawn irrigation system.

Rotation of the worm shaft 44 causes the first gears 50 to rotate. Rotation of the first gears 50 then causes the second gears 60 to rotate, which causes the second shaft 62 and the drive wheels 24 to rotate. Interaction of the components in the motor 22 is more clearly illustrated in FIGS. 6–8 that are sectional views taken along different locations in the motor 22.

Figure 4:
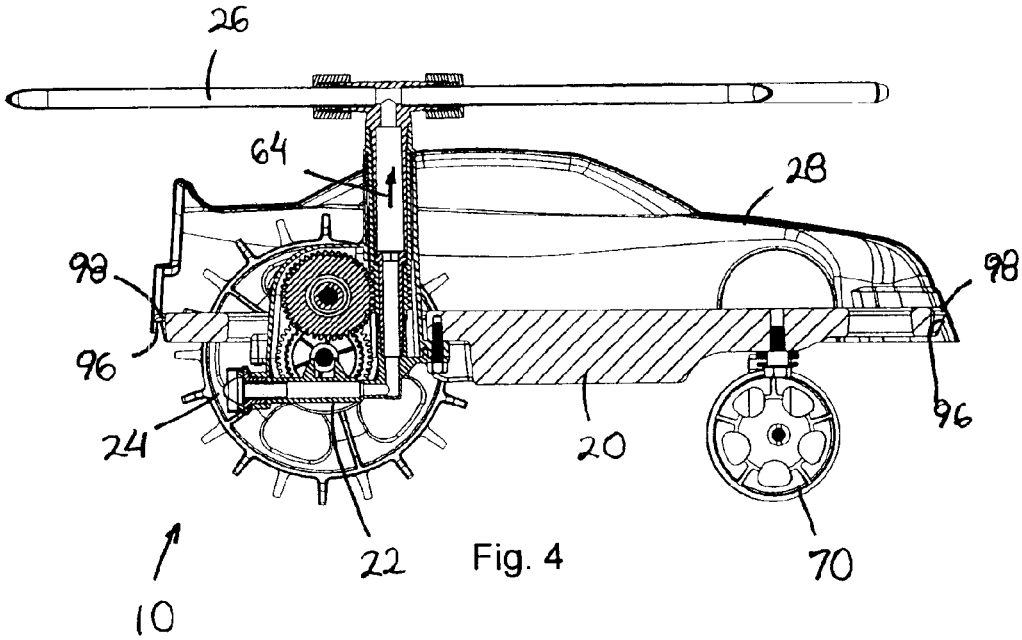
FIG. 4 is a sectional view of the lawn irrigation system illustrated in FIG. 1.

The water moves through the lawn irrigation system 10 along a pathway 64, as most clearly illustrated in FIG. 4. The motor 22 includes a hose attachment mechanism 66 for feeding water into the motor 22. The hose attachment mechanism 66 preferably has a threaded connection that is commonly used with garden hoses. A person of ordinary skill in the art will appreciate that alternative mechanisms may be used for attaching the lawn irrigation system 10 to a water supply.

A person of ordinary skill in the art will also appreciate that it is necessary to use sealing mechanisms such as gaskets at locations in the motor 22 where components meet to prevent water from leaking out of the motor 22.

The motor 22 may also include a multiple speed gear system where the motor is selectively operably at a low speed or a high speed. This multiple gear system may be accomplished by including gears having different diameters. Selection of the different speeds is preferably done manually by shifting the gears using a selector that extends outside of the motor 22.

The lawn irrigation system 10 may also include a stop mechanism that stops the flow of water through the lawn irrigation system 10. One such stop mechanism is attached to a front bumper on the lawn irrigation system 10. When the front bumper contacts an object, the water flow is stopped through mechanical connection between the front bumper and the motor 22.

The lawn irrigation system 10 preferably includes two drive wheels 24. Each of the drive wheels 24 preferably includes a plurality of teeth 68 extending outwardly therefrom.

Selection of a shape of the teeth 68 and a pattern for the teeth 68 is done based upon the types of lawns on which it is intended to use the lawn irrigation system 10. The drive wheels 24 each preferably include 20 teeth that are arranged in an alternating pattern along opposite edges of the drive wheels 24. The teeth 68 preferably have a tapered profile so that the teeth are wider proximate attachment to the drive wheel 24.

Proximate the front end of the frame 20, the lawn irrigation system 10 preferably includes a guide wheel assembly 70. The guide wheel assembly 70 includes a guide wheel frame 72, a guide wheel 74, and a shaft 76 that rotatably mounts the guide wheel 74 to the guide wheel frame 72. The guide wheel frame 72 is preferably pivotally mounted to the frame 20.

The guide wheel 76 has a concave outer surface 78 so that the guide wheel 76 at least partially conforms to an outer surface of a garden hose (not shown) to which the lawn irrigation system 10 is attached.

When the garden hose is arranged in a desired pattern on a lawn, the guide wheel 70 facilitates guiding the lawn irrigation system 10 over a desired path on a lawn to thereby ensure that all portions of the lawn receive a desired level of irrigation.

The sprinkler arm 26 is rotatably attached to the worm shaft 44. The sprinkler arm 26 generally includes a T-shaped section 80 and a pair of spray tubes 82 removably attached opposite ends of the T-shaped section 80. The spray tubes 82 are thereby oriented substantially perpendicular to the worm shaft 44.

The spray tubes 82 each have a first portion 84 and a second portion 86 that is oriented at an angle $\alpha$ with respect to the first portion 84. The angle $\alpha$ is preferably less than 45°. More preferably, the angle $\alpha$ is between 10° and 30°. Most preferably, the angle $\alpha$ is about 20°.

The spray tubes 82 are preferably rotatable about an axis that is perpendicular to an axis about which the worm shaft 44 rotates. Rotating the spray tubes 82 with respect to the T-shaped section 80 enables the pattern at which water is discharged from the lawn irrigation system 10 to be varied.

The sprinkler arm 26 also preferably includes a nozzle 88 attached to each of the spray tubes 72 opposite the T-shaped section 70. The nozzle 88 further enables the pattern at which water is discharged from the lawn irrigation system 10 to be varied. For example, the nozzle 88 may promote the formation of small or large water droplets.

The cover 28 is preferably in the shape of an automobile stock car. In addition to having the shape of a stock car, the automobile-shaped cover 28 is preferably painted with colors and includes indicia printed thereon that are substantially identical to actual stock cars.

The cover 28 is preferably prepared using the following process. A pattern corresponding with the physical and color features is printed on a sheet of durable plastic composition such as polycarbonate. A person of ordinary skill in the art will appreciate that there are a variety of suitable techniques that can be used for printing on the plastic sheet.

The plastic sheet is preferably printed in a substantially flat configuration. To compensate for stretching of portions of the plastic sheet during the molding process, the pattern is preferably distorted prior to printing. The initial distortion is overcome during the molding process so that the molded cover has a desired appearance. To facilitate determining the appropriate distortion, a grid with perpendicularly oriented lines is printed on the plastic sheet and then molded.

Next, the printed sheet is formed into a shape that resembles an automobile by placing the printed sheet over a male mold section. The formed printed sheet is covered with a first plastic composition. The first plastic composition then solidifies into a durable translucent outwardly facing layer on the formed printed sheet so that the pattern is visible from an outer surface of the automobile-shaped cover.

To further enhance the strength of the cover 28, a second plastic composition is preferably molded over an inner surface of the cover 28. The inner layer 84 formed from the second plastic composition includes a recess 96 proximate the front and back ends of the cover 28, as most clearly illustrated in FIG. 4. The recesses are adapted to receive tabs 98 extending from the front and back ends of the frame 20.

Alternatively, the cover 28 may be fabricated from injection-molded plastic and then painted to have a desired appearance. A person of ordinary skill in the art will appreciate that it is possible to use other materials to fabricate the decorative shell such as steel. When forming the decorative shell from steel, the decorative shell is preferably cast.

As an alternative to fabricating the frame 20 separately from the cover 28, it is possible to integrally fabricate the frame 20 and the cover 28. In this configuration, the frame would preferably have a recess on a lower surface thereof that is adapted to receive a water-powered motor that causes the moving lawn irrigation system to move along the lawn.

Figure 9:
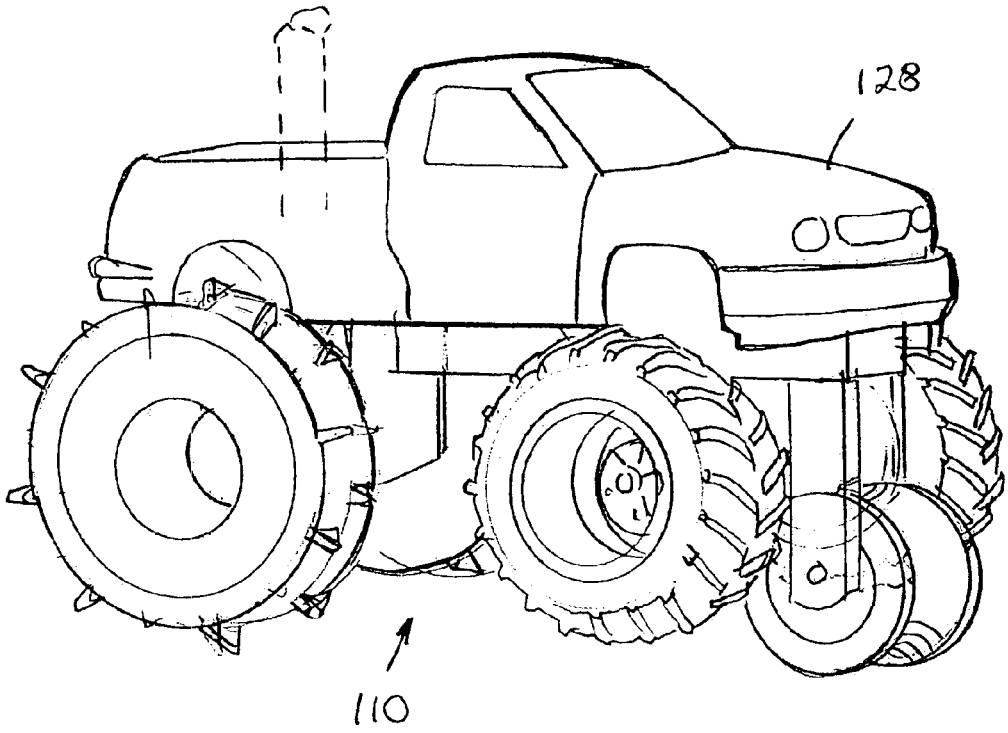
FIG. 9 is a perspective view of another embodiment of the lawn irrigation system where an outer cover is in the shape of a monster truck.
Figure 10:
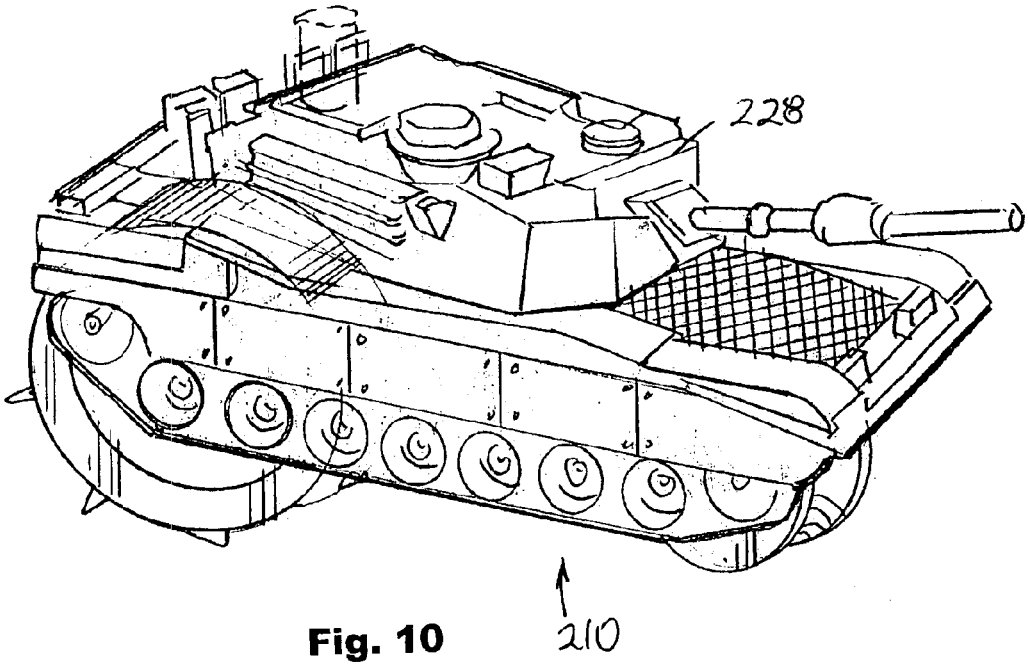
FIG. 10 is a perspective view of another embodiment of the lawn irrigation system where an outer cover is in the shape of a tank.
Figure 11:
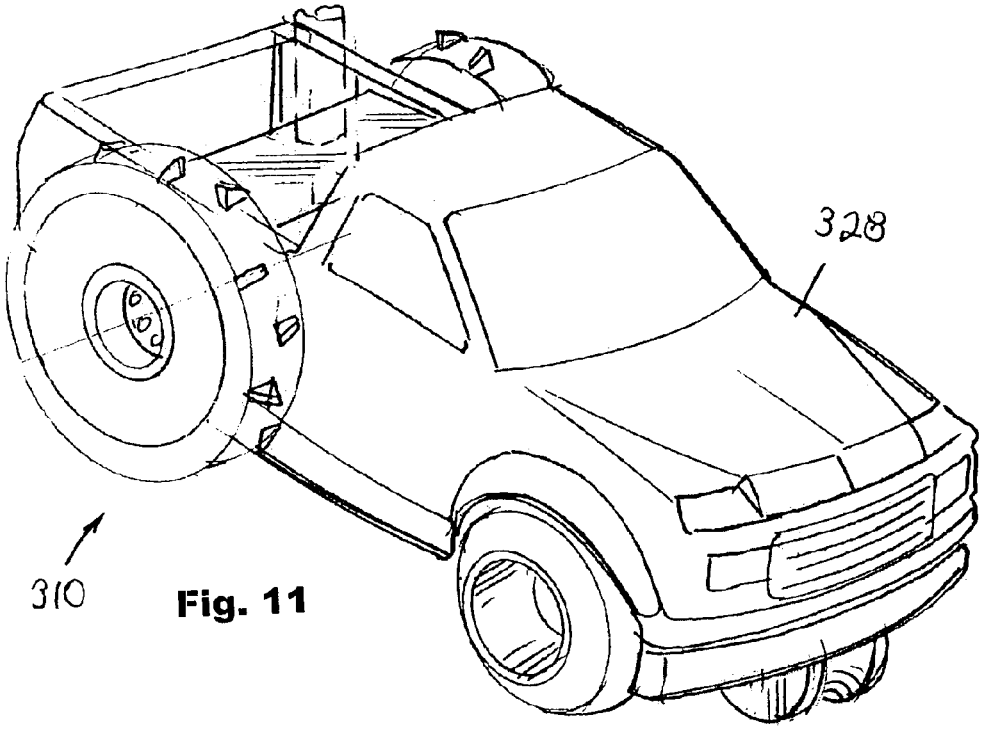
FIG. 11 is a perspective view of another embodiment of the lawn irrigation system where an outer cover is in the shape of a pick-up truck.
Figure 12:
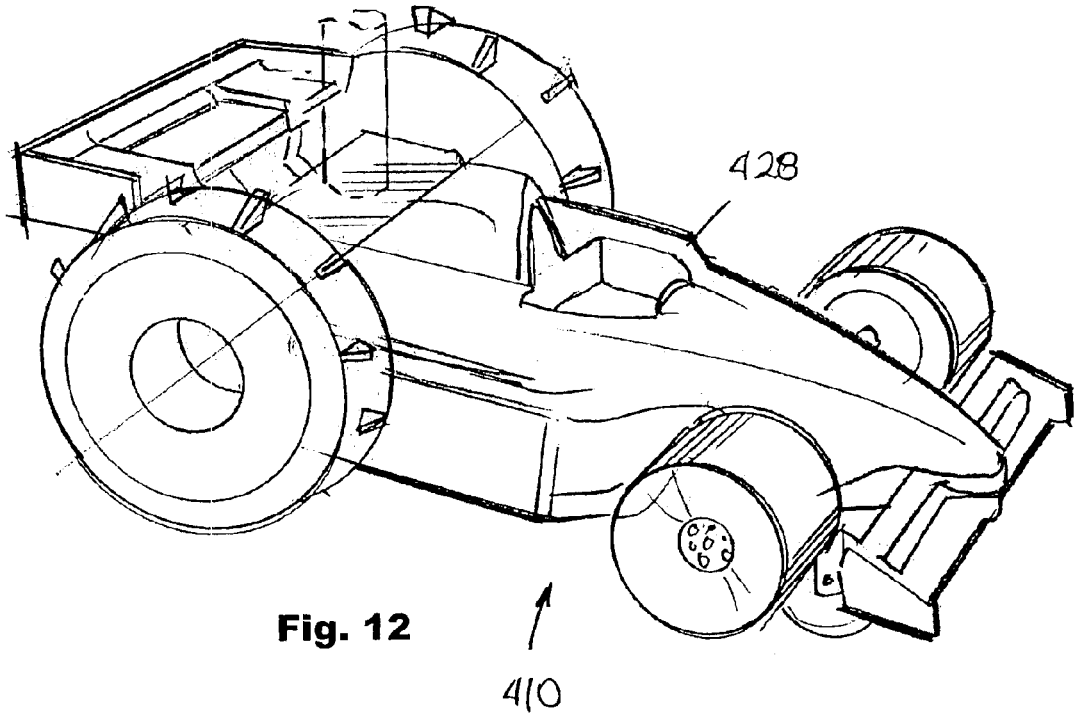
FIG. 12 is a perspective view of another embodiment of the lawn irrigation system where an outer cover is in the shape of an Indy car.
Figure 13:
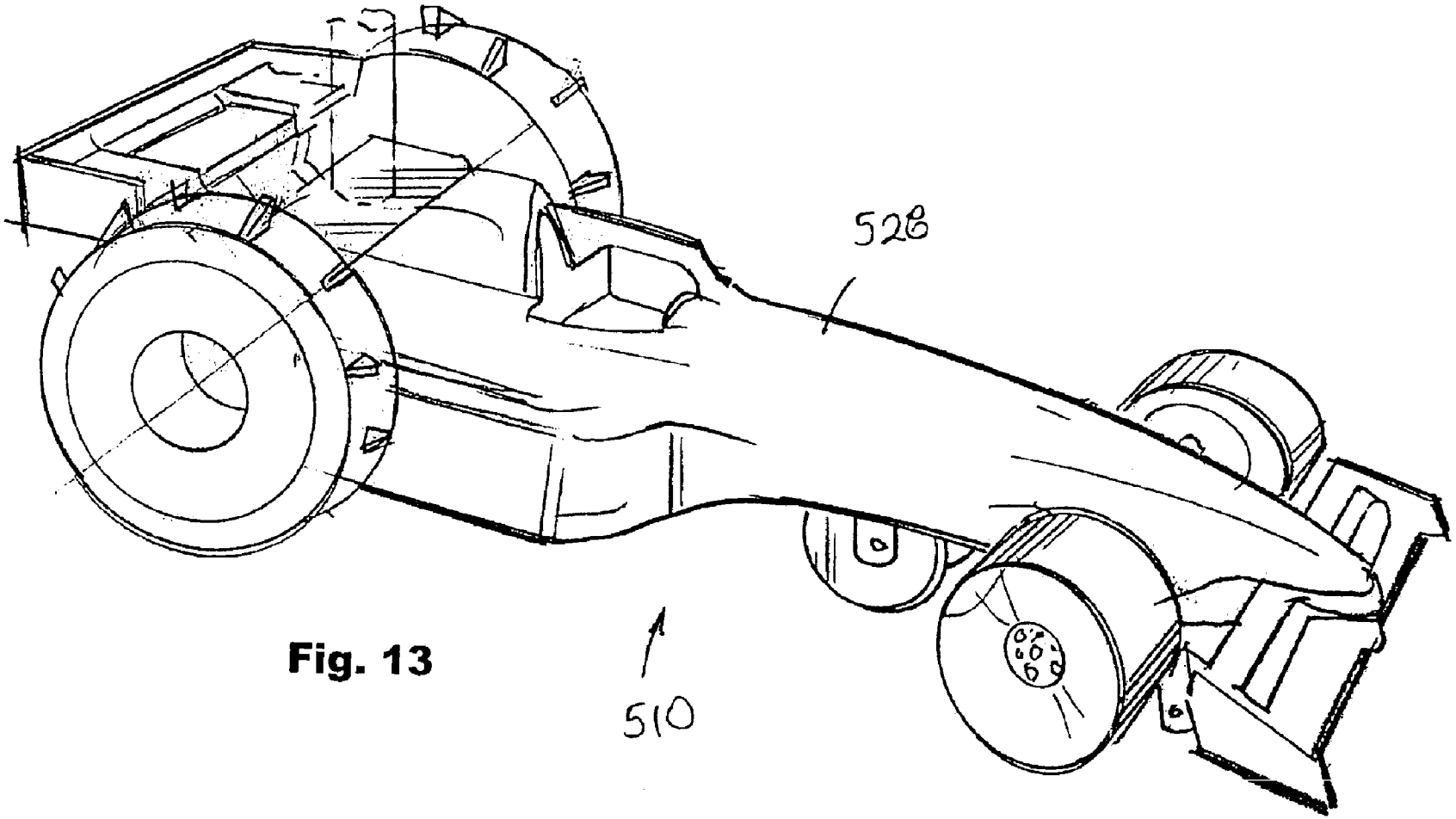
FIG. 13 is a perspective view of another embodiment of the lawn irrigation system where an outer cover is in the shape of a dragster.

The concepts of the present invention may be utilized with vehicles other than automobiles. For example, the cover 128 of the lawn irrigation system 110 may be in the shape of a monster truck, as illustrated in FIG. 9. The cover 228 of the lawn irrigation system 210 may be in the shape of a tank or other military vehicle, as illustrated in FIG. 10. The cover 328 of the lawn irrigation system 310 may be in the shape of a pick-up truck, as illustrated in FIG. 11. The cover 428 of the lawn irrigation system 410 may be in the shape of an Indy car, as illustrated in FIG. 12. The cover 528 of the lawn irrigation system 510 may be in the shape of a dragster, as illustrated in FIG. 13. Still other shapes that are suitable for use in the decorative shell include sporting equipment such as footballs, baseballs, and hockey pucks.

Still another configuration of the lawn irrigation system cover would have substantially flat or curved sides to facilitate placing a trademark or other indicia on the lawn irrigation system cover.

As an alternative to only marketing a complete lawn irrigation system 10, it is also possible to sell the covers separately so that the cover can be changed at different times of the year. For example, a football helmet can be placed on the lawn irrigation system during football season and a baseball-shaped cover can be placed on the lawn irrigation system during baseball season.

The present invention is also directed to a method of irrigating lawns while showing the person's affiliation or support of a particular automobile, organization, or group. For example, when the automobile-shaped cover has a stock car with a color and indicia scheme that is similar to a particular racing team, the person using the lawn irrigation system will show to others that the user is affiliated with or supports the racing team. Alternatively, if the cover has the shape of a football, the person using the lawn irrigation system will display to others his/her fondness for the game of football.

Moving of the lawn irrigation system during the lawn irrigation process thereby attracts the attention of persons in the area of the lawn irrigation system.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A method of irrigating a lawn, the method comprising:

fabricating a lawn irrigation system, comprising:

operably attaching a motor to a frame operably connecting at least one drive wheel to the motor;

operably connecting a sprinkler arm to the motor; and removably attaching a first cover to at least partially cover the frame, the motor, and the at least one drive wheel so that the lawn irrigation system resembles an object other than a sprinkler;

connecting the motor to a water hose;

flowing water though the motor and the sprinkler arm to cause the at least one drive wheel to rotate and thereby move the lawn irrigation system over the lawn;

dispersing water in a selected pattern from the sprinkler arm, wherein a person using the lawn irrigation system displays a fondness for a particular type of organization or group; and manually detaching the first cover from the frame;

removably attaching a second cover to the frame, wherein the second cover has at least one of a different shape and different color than the first cover.

2. The method of claim 1, and further comprising:

operably attaching at least one guide wheel to the frame;

orienting the water hose in a selected path on the lawn; and irrigating the lawn by rolling the at least one guide wheel along the water hose.

3. The method of claim 1, wherein the cover is formed in the shape of an automobile, monster truck, tank, pick-up truck, Indy car, or dragster.

4. The method of claim 1, and further comprising providing the motor with at least two gear ratios.

5. The method of claim 1, and further comprising operably attaching a stop mechanism to the motor, which enables flow of water through the lawn irrigation system to substantially stop.

* * * * *